US008070503B2

(12) United States Patent
Mak

(10) Patent No.: US 8,070,503 B2
(45) Date of Patent: Dec. 6, 2011

(54) CHARGING INTERFACE FOR RECHARGEABLE DEVICES

(75) Inventor: Paul Mak, Dong Guan (CN)

(73) Assignee: Spin Master Ltd., Toronto, Ontario (CA)

( * ) Notice: Subject to any disclaimer, the term of this patent is extended or adjusted under 35 U.S.C. 154(b) by 150 days.

(21) Appl. No.: 12/472,017

(22) Filed: May 26, 2009

(65) Prior Publication Data

US 2010/0304578 A1 Dec. 2, 2010

(51) Int. Cl.
*H01R 13/62* (2006.01)

(52) U.S. Cl. ..... 439/260; 439/59; 439/171

(58) Field of Classification Search ..... 439/640, 439/59, 577, 260, 171, 951, 217, 218
See application file for complete search history.

(56) References Cited

U.S. PATENT DOCUMENTS

| | | | | |
|---|---|---|---|---|
| 3,568,129 | A * | 3/1971 | Gold et al. | 439/70 |
| 3,598,985 | A * | 8/1971 | Harnden et al. | 439/56 |
| 3,778,742 | A | 12/1973 | Merrill | |
| 3,794,954 | A * | 2/1974 | Reimer | 439/62 |
| 4,445,742 | A * | 5/1984 | Fullam | 439/597 |
| 4,679,879 | A | 7/1987 | Triner et al. | |
| 6,135,798 | A | 10/2000 | Saruta et al. | |
| 6,146,150 | A * | 11/2000 | Roberts | 439/55 |
| 6,190,194 | B1 * | 2/2001 | Kubota | 439/929 |
| 6,672,906 | B1 | 1/2004 | Kimura | |
| 6,899,546 | B2 * | 5/2005 | Longueville et al. | 439/64 |
| 7,101,188 | B1 * | 9/2006 | Summers et al. | 439/59 |
| 7,121,850 | B2 * | 10/2006 | Yeh | 439/171 |
| 7,364,436 | B2 * | 4/2008 | Yen | 439/76.1 |
| 7,427,216 | B1 * | 9/2008 | Wu et al. | 439/638 |
| 7,455,531 | B2 * | 11/2008 | Hirabayashi et al. | 439/67 |
| 2002/0182929 | A1 * | 12/2002 | Chang et al. | 439/500 |

FOREIGN PATENT DOCUMENTS

EP 356757 A2 * 3/1990

* cited by examiner

*Primary Examiner* — Briggitte R Hammond
(74) *Attorney, Agent, or Firm* — Cozen O'Connor

(57) ABSTRACT

A novel charging interface for rechargeable devices is disclosed herein. The present charging interface has a male plug, formed from circuit board material, which electrically and slidably interconnects with a female socket in at least two orientations. The female socket has electrically conductive biasing means which retain the male plug within the female socket. The charging interface provides electrical contact between the master circuit board of a rechargeable device and a power source.

18 Claims, 4 Drawing Sheets

CHARGING INTERFACE FOR RECHARGEABLE DEVICES

FIELD OF THE INVENTION

The present invention relates to charging interfaces for rechargeable devices.

BACKGROUND OF THE INVENTION

Rechargeable devices are extremely popular and quite commonplace. Laptops, remotely controlled toys and cellular telephones, among other devices, all require regular recharging, and typically this involves connecting the rechargeable device to a charger in order to recharge the device's internal batteries. Chargers can contain either an AC/DC converter so that they can connect directly to an AC power source, or have an internal DC power source (such as replaceable batteries).

The connection between a rechargeable device and a charger, or charging interface, typically consists of a male plug and a female socket which slidably interconnect. Each of the male plug and the female socket may be located either on the device itself or on the charger. Regardless of orientation, the device side of the charging interface is often mounted on or otherwise connected to a circuit board located inside the device.

For many rechargeable devices, the electrical connection between the rechargeable device and the power source is unique to the device, such that connecting a rechargeable device with a charger not intended for use with that device can cause damage to the device. In that case, it is important for the charging interface to be designed so that it is difficult or impossible to accidentally use the wrong charger when attempting to recharge the device.

Plugging and unplugging the rechargeable device from its battery charger can damage the connection between the device portion of the charging interface and the circuit board it is attached to within the device, as the device portion of the charging interface is generally soldered to the circuit board and soldering material can be brittle when stressed. Once these soldered connections are cracked or otherwise damaged, electrical contact may be lost.

Furthermore, many prior art charging interfaces have delicate male prongs which fit into corresponding female slots. These male prongs can be bent or otherwise misshaped or even broken when the male prongs are incorrectly inserted in the female slots, resulting in an inoperable charging interface. Furthermore, if the male prongs are inserted incorrectly into the female slots, an incorrect electrical connection can be made, which could cause the interface to be inoperable, or even damage the device or cause injury to the user.

Accordingly, there is a need for a charging interface that is simple to use and durable and which does not place unnecessary strain on the circuit board on which it is mounted.

SUMMARY OF THE INVENTION

The present invention provides a charging interface for rechargeable devices which is more durable and easier to use than charging interfaces presently available in the prior art.

The present charging interface comprises a female socket and a corresponding single male plug, which is a circuit board and which slidably and electrically interconnects with the female socket in at least two orientations. One of the male plug and the female socket makes electrical contact with the master circuit board and the other of the male plug and the female socket is adapted to be electrically connected to a power source. The present charging interface is particularly durable as there are no delicate male prongs which could be bent or broken if the male part of the plug were improperly inserted in the female slot.

In at least one embodiment, the male plug is formed from a piece of circuit board substrate and fits snugly into a provided slot on the master circuit board, where it may then be soldered into place. This acts to stabilize the male plug and to render the male plug particularly resistant to twisting or bending at the male plug/master circuit board interface, thereby greatly reducing the stress on the solder connections which maintain electrical contact between the male plug and the master circuit board. Alternatively, the male plug may be integrally formed in the master circuit board.

Furthermore, the male plug of the present charging interface is non-directional as it has at least two surfaces which each have positive and negative poles in the same electrical configuration. Therefore, each surface will interact correctly with the positive and negative poles in the female socket, and therefore any orientation in which the male plug can be inserted into the female socket will provide an appropriate electrical connection. This makes the present charging interface easier to use than other prior art plugs currently available.

BRIEF DESCRIPTION OF THE DRAWINGS

Preferred embodiments of the present charging interface will now be described in greater detail and will be better understood when read in conjunction with the following drawings in which.

DETAILED DESCRIPTION OF THE INVENTION

Figure 1:
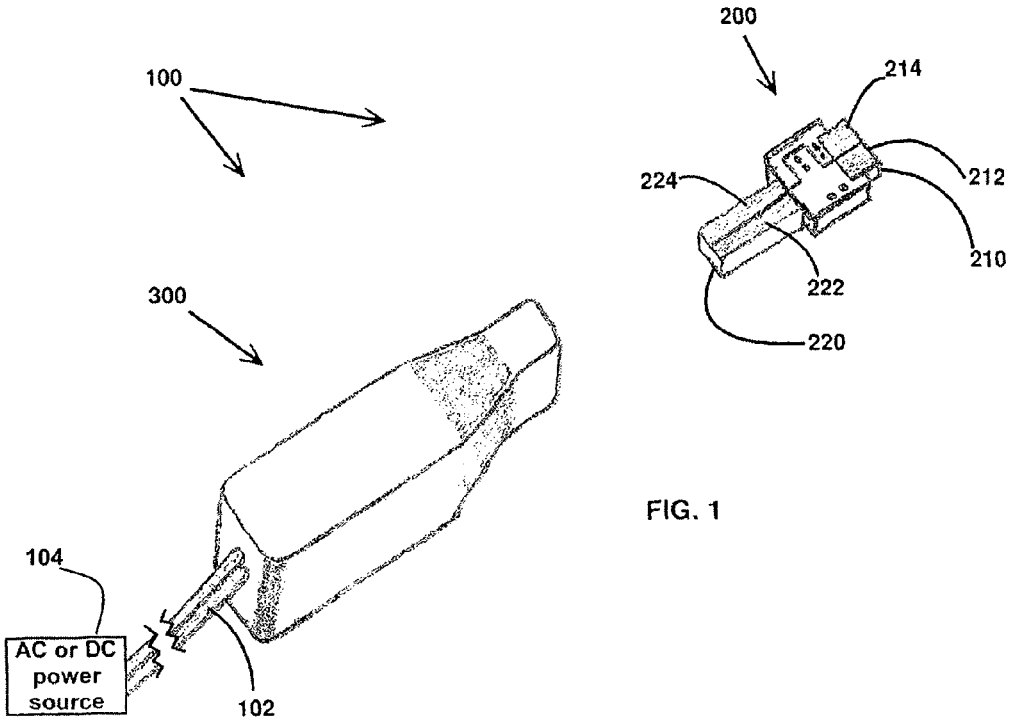
FIG. 1 is a perspective view of one embodiment of the present charging interface when the male plug is not interconnected with the female slot.

With reference to FIG. 1, in at least one embodiment the charging interface 100 of the present invention comprises a male plug 200 adapted to slidably interconnect with female socket 300. It will be apparent to the skilled person that the external housing of the female socket 300 may have any convenient shape, provided that the female socket interconnects with the male plug. Female socket 300 has a power cord 102 which can be further connected to an AC or a DC power source 104.

In at least one embodiment, male plug 200 is formed from standard circuit board substrate, however other materials suitable for use in a circuit board are also contemplated. Male plug 200 has a first end 210 and a second end 220. First end 210 is preferably wider than second end 220, however other configurations are contemplated.

Figure 2:
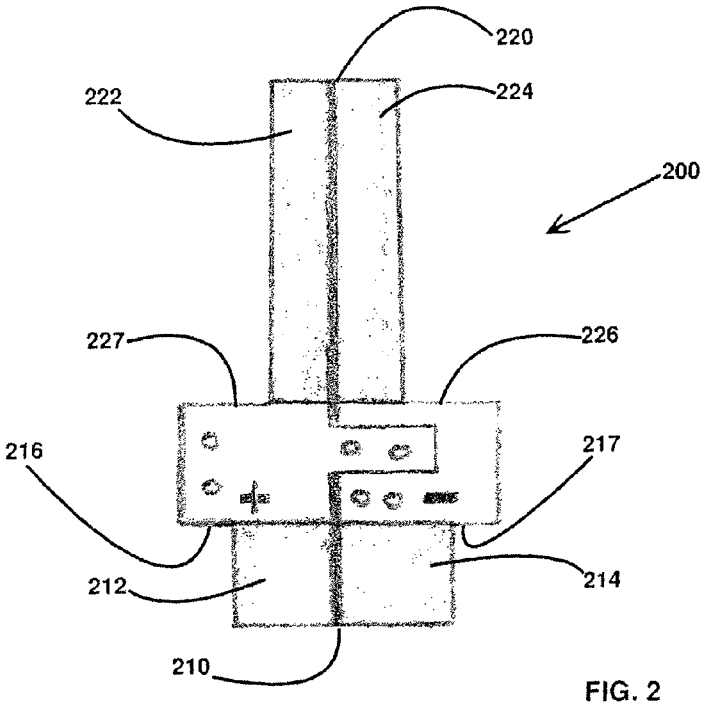
FIG. 2 is a plan view of one embodiment of the male plug of the present charging interface.
Figure 3:
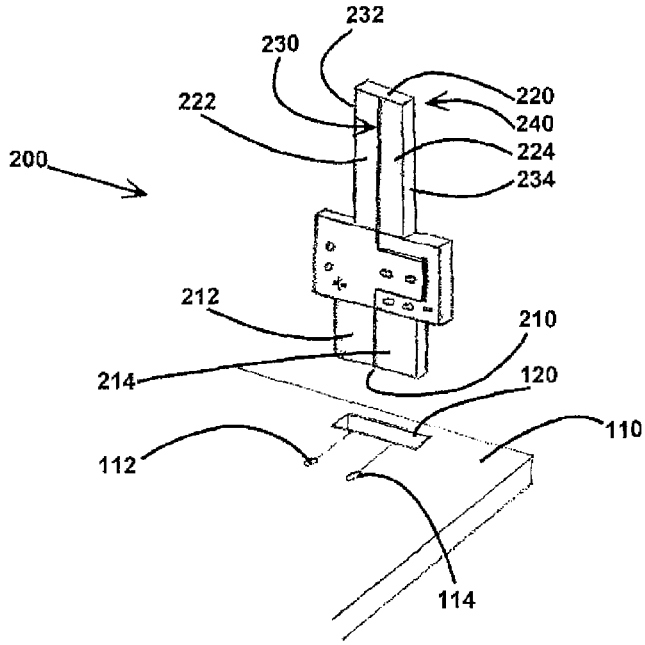
FIG. 3 is an exploded view of one embodiment of the male plug and its corresponding receiving slot on a master circuit board of a rechargeable device.

With reference to FIGS. 2 and 3, in at least one embodiment first end 210 is narrower than the widest part of male plug 200. This creates two first shoulders 216, 217 which abut master circuit board 110 and provide stability when male plug 200 is mounted in receiving slot 120 of master circuit board 110, particularly when male plug 200 is connected with female socket 300 with a pushing force. Furthermore, second end 220 is also preferably narrower than the widest part of male plug 200, which creates two second shoulders 226, 227. Second shoulders 226, 227 can abut female socket 300 when male plug 200 is interconnected with female socket 300, or in at least one embodiment second shoulders 226, 227 abut a retaining slot (not shown) located in a rechargeable device. This stabilizes male plug 200, particularly when the male plug 200 is disconnected from female socket 300 with a pulling force.

With reference to FIG. 3, in at least one embodiment male plug 200 is formed such that first end 210 fits into receiving slot 120 of master circuit board 110 and first shoulders 216, 217 abut master circuit board 110. It is preferable that first end 210 fits into receiving slot 120 with a snug fit, such that male plug 200 does not disengage from receiving slot 120 without applying a significant pulling force. Male plug 200 may then be soldered into place on master circuit board 110 such that positive contact 112 and negative contact 114 of master circuit board 110 are electrically connected to, respectively, the first positive pole 212 and first negative pole 214 of male plug 200.

Figure 6:
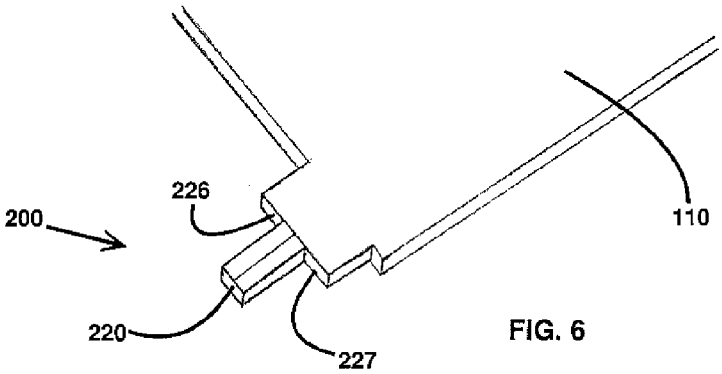
FIG. 6 is a perspective view of one embodiment of the male plug and circuit board interface of the present invention.
Figure 7:
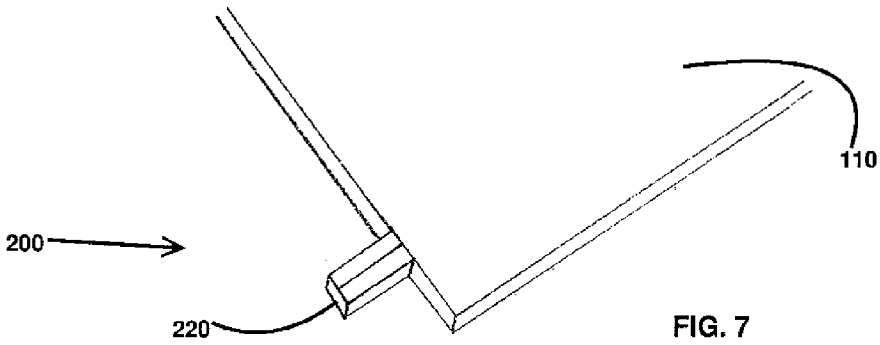
FIG. 7 is a perspective view of one embodiment of the male plug and circuit board interface of the present invention.

With reference to FIGS. 6 and 7, it is also contemplated that male plug 200 can be integrally formed in master circuit board 110. In at least one embodiment, first end 210 of male plug 200 can be integrally formed from master circuit board 110, or in an alternative configuration, second end 220 of male plug 200 may simply project directly from master circuit board 110 as shown in FIG. 7.

Figure 8A:
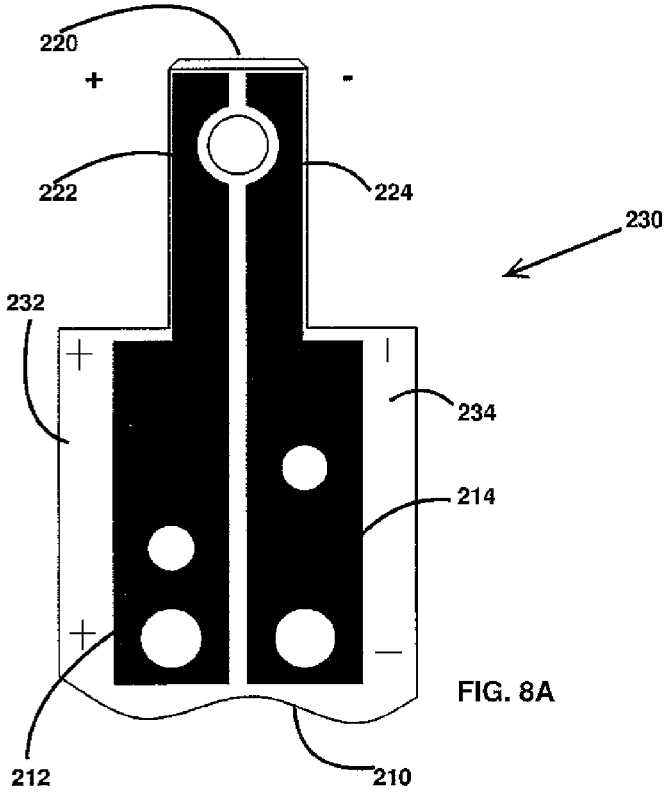
FIG. 8A is a schematic diagram illustrating the electrical configuration of one surface of one embodiment of the male plug of the present invention.
Figure 8B:
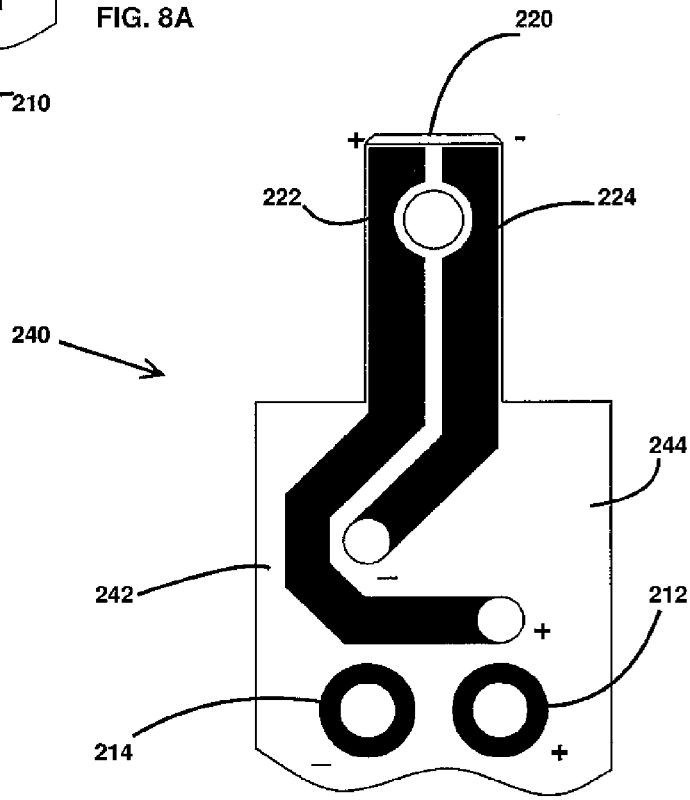
FIG. 8B is a schematic diagram illustrating the electrical configuration of the surface opposite to that shown in FIG. 8A.

Referring to FIGS. 3, 8A and 8B, male plug 200 has first surface 230, having lateral sides 232 and 234, and a second surface 240, having lateral sides 242 and 244. Each surface has a second positive pole 222 and a second negative pole 224 in end 220 which are electrically connected to, respectively, the first positive pole 212 and first negative pole 214 in end 210. Poles 212 and 214 can be connected electrically to poles 222 and 224 respectively by any known means in the art. In at least one embodiment, poles 212 and 214 are electrically connected to poles 222 and 224 by way of a provided copper circuit which is etched into the body of male plug 200.

As can be seen in FIG. 8A, first surface 230 is laid out such that first positive pole 212 and second positive pole 222 are both located in one lateral side 232, while first negative pole 214 and second negative pole 224 are both located in the opposite lateral side 234. In contrast, as seen in FIG. 8B, second surface 240 is laid out such that first negative pole 214 and second positive pole 222 are both located in one lateral side 242, while first positive pole 212 and second negative pole 224 are both located in the opposite lateral side 244. In this way, an identical configuration of poles 222 and 224 is presented on each surface 230 or 240 of second end 220 of male plug 200.

Figure 4:
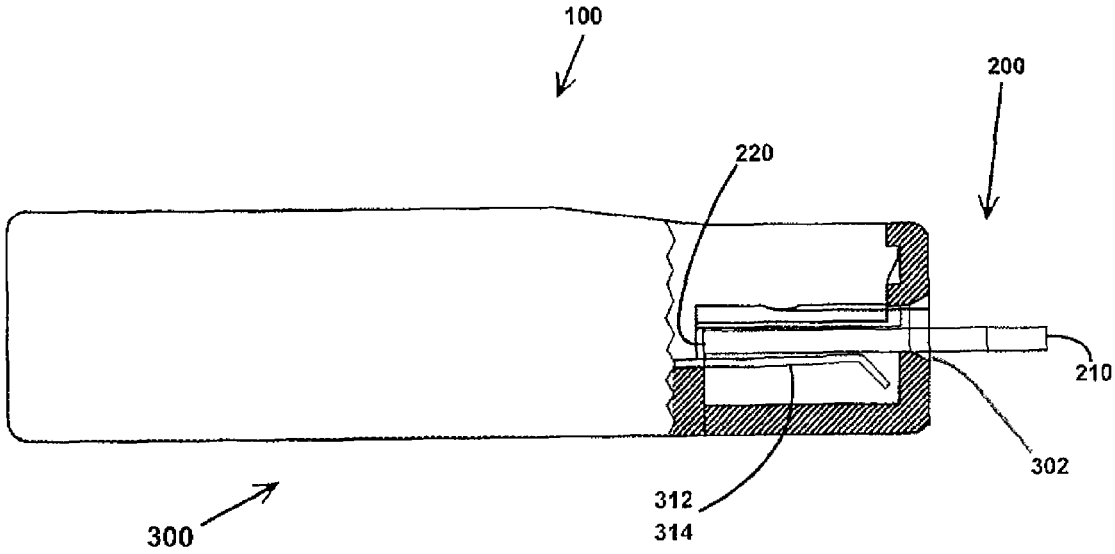
FIG. 4 is a cutaway view of one embodiment of the present charging interface illustrating the male plug/female slot interface.
Figure 5:
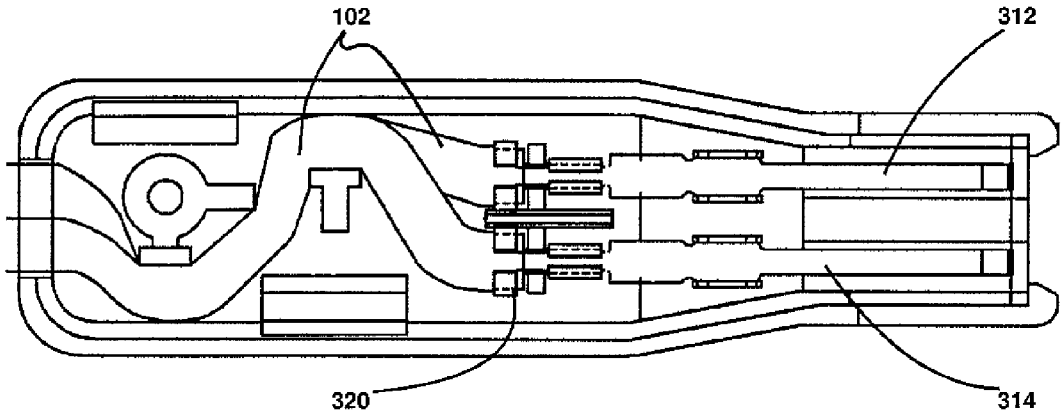
FIG. 5 is a plan view in cross section of one embodiment of the female socket of the present invention.

With reference to FIG. 4, a cutaway view of one embodiment of the present charging interface 100 is illustrated in which male plug 200 is electrically interconnected with female socket 300. Female socket 300 is, in at least one embodiment, formed of a non-electrically conductive material, including but not limited to ceramic or plastic, however any material that does not conduct electricity could be used. The shape of the external housing of female socket 300 can be any convenient shape, provided that male plug 200 can interconnect with female socket 300. With reference to FIGS. 4 and 5, in at least one embodiment second end 220 contacts a positive electrical contact 312 and a negative electrical contact 314 in female socket 300. It will be apparent to the skilled person that when either surface 230 or surface 240 of end 220 of male plug 200 is presented to electrical contacts 312 and 314, second positive pole 222 will contact positive electrical contact 312 and second negative pole 224 will contact negative electrical contact 314. This provides that male plug 200 can be inserted into female plug 300 in either orientation, without affecting electrical connectivity.

In at least one embodiment, electrical contacts 312 and 314 are formed in the shape of a leaf spring. As electrical contacts 312 and 314 are deformed, they provides a biasing force which retains male plug 200 within female socket 300 while maintaining electrical connectivity between electric contacts 312 and 314 and each of second positive pole 222 and second negative pole 224 respectively. Other methods of retention known in the art could be employed to retain male plug 200 within female socket 300, provided that second positive pole 222 contacts positive electrical contact 312 and second negative pole 224 contacts negative electrical contact 314 respectively. Electrical contacts 312 and 314 are preferably formed of metal, however they can be formed of any material suitable for the application requirements, provided that the material chosen is electrically conductive.

Electrical contacts 312 and 314 are further connected to power cord 102. Power cord 102 is preferably multistrand wire with a negative bundle and a positive bundle, however a ground bundle or other wire arrangement may be necessary depending on the application. Positive bundle of power cord 102 is electrically connected to positive electrical contact 312 and negative bundle of power cord 102 is electrically connected to negative electrical contact 314 respectively by way of retaining means 320. Retaining means 320 can be a spring, clip, screw or any other known manner in which a electric wire may be electrically connected to an electrically conductive piece of material.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

The invention claimed is:

1. A charging interface for recharging a rechargeable device by providing electrical contact between a master circuit board of the rechargeable device and a power source, the charging interface comprising:

a female socket; and a male plug, wherein the male plug is a circuit board configured to slidably and electrically interconnect with the female socket in at least two orientations;

wherein one of the female socket and the male plug is adapted to make electrical contact with the master circuit board and the other of the male plug and the female socket is adapted to make electrical contact with the power source;

wherein electrical interconnection between the male plug and the female socket acts to recharge the rechargeable device when the one of the female socket and the male plug is in electrical contact with the master circuit board and the other of the male plug and the female socket is in electrical contact with the power source.

2. The charging interface of claim 1, wherein the one of the female socket and the male plug is a male plug, and the male plug is adapted to make intimate electrical contact with the master circuit board.

3. The charging interface of claim 2, wherein the male plug is integral with the master circuit board.

4. The charging interface of claim 2, wherein the male plug further comprises a first end and a second end, the first end adapted to intimately and electrically interconnect with a receiving slot in the master circuit board, the second end adapted to slidably and electrically interconnect with the female socket.

5. The charging interface of claim 1, wherein the female socket comprises at least one leaf spring electrical contact.

6. The charging interface of claim 1, wherein the other of the male plug and the female socket is adapted to make electrical contact with an AC power source.

7. The charging interface of claim 1, wherein the other of the male plug and the female socket is adapted to make electrical contact with a DC power source.

8. A rechargeable device having a master circuit board and being rechargeable when the master circuit board is in electrical contact with a power source, the electrical contact being provided by a charging interface comprising a female socket and a male plug, wherein the male plug is a circuit board and the male plug and the female socket are configured to mutually, slidably and electrically interconnect in at least two orientations, wherein one of the female socket and the male plug is adapted to make electrical contact with the master circuit board and the other of the male plug and the female socket is adapted to make electrical contact with the power source, the rechargeable device comprising the one of the female socket and the male plug.

9. The rechargeable device of claim 8, wherein the one of the female socket and the male plug is a male plug, and wherein the male plug is adapted to make intimate electrical contact with the master circuit board.

10. The rechargeable device of claim 9, wherein the male plug is integral with the master circuit board.

11. The rechargeable device of claim 9, wherein the male plug further comprises a first end and a second end, the first end adapted to intimately and electrically interconnect with a receiving slot in the master circuit board, the second end adapted to slidably and electrically interconnect with the female socket.

12. The rechargeable device of claim 8, wherein the one of the female socket and the male plug is a female socket, and wherein the female socket comprises at least one leaf spring electrical contact.

13. A charging unit for recharging a rechargeable device having a master circuit board and being rechargeable when the master circuit board is in electrical contact with a power source, the electrical contact being provided by a charging interface comprising a female socket and a male plug, wherein the male plug is a circuit board and the male plug and the female socket are configured to mutually, slidably and electrically interconnect in at least two orientations, wherein one of the female socket and the male plug is adapted to make electrical contact with the master circuit board and the other of the male plug and the female socket is adapted to make electrical contact with the power source, the charging unit being adapted for connection to the power source, and the charging unit comprising the other of the male plug and the female socket.

14. The charging unit of claim 13, wherein the other of the male plug and the female socket is a male plug.

15. The charging unit of claim 13, wherein other of the male plug and the female socket a female socket.

16. The charging unit of claim 15, wherein the female socket comprises at least one leaf spring electrical contact.

17. The charging unit of claim 13, wherein the other of the male plug and the female socket is adapted to make electrical contact with an AC power source.

18. The charging unit of claim 13, wherein the other of the male plug and the female socket is adapted to make electrical contact with a DC power source.

* * * * *